US008241073B2

(12) United States Patent
Hemmi et al.

(10) Patent No.: US 8,241,073 B2
(45) Date of Patent: Aug. 14, 2012

(54) TERMINAL WITH A U-SHAPE SUPPORT STRUCTURE PROTRUDING FROM ITS SIDE

(75) Inventors: Yoshinobu Hemmi, Otsu (JP); Hirotada Teranishi, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/674,455

(22) PCT Filed: Mar. 10, 2009

(86) PCT No.: PCT/JP2009/054538

§ 371 (c)(1),
(2), (4) Date: May 6, 2011

(87) PCT Pub. No.: WO2009/113533

PCT Pub. Date: Sep. 17, 2009

(65) Prior Publication Data

US 2011/0212655 A1 Sep. 1, 2011

(30) Foreign Application Priority Data

Mar. 14, 2008 (JP) ..... 2008-066168

(51) Int. Cl.
*H01R 13/514* (2006.01)

(52) U.S. Cl. ..... 439/752

(58) Field of Classification Search ..... 439/752, 439/422, 595, 752.5
See application file for complete search history.

(56) References Cited

U.S. PATENT DOCUMENTS 4,357,065 A * 11/1982 Kam et al. ..... 439/422
4,474,417 A * 10/1984 Millhimes et al. ..... 439/271
5,176,537 A * 1/1993 Samejima et al. ..... 439/595
5,842,884 A * 12/1998 Maegawa et al. ..... 439/595
5,934,927 A * 8/1999 Nagai ..... 439/397
5,993,268 A * 11/1999 Yamaguchi ..... 439/752.5
7,517,232 B2 * 4/2009 Yuan et al. ..... 439/79
2005/0054246 A1 3/2005 Zhang
2007/0105441 A1 5/2007 Shen et al.
2007/0123094 A1 5/2007 Su et al.
2007/0134964 A1 6/2007 Hsu et al.

FOREIGN PATENT DOCUMENTS

JP 57-70679 U 4/1982

(Continued)

OTHER PUBLICATIONS

Extended European Seach Report for Application No. 09720727.8 dated Jun. 1, 2011 (8 pages).
International Search Report w/translation from PCT/JP2009/054538 dated Apr. 14, 2009 (4 pages).

(Continued)

*Primary Examiner* — Chandrika Prasad
(74) *Attorney, Agent, or Firm* — Osha Liang LLP

(57) ABSTRACT

A terminal support structure has a housing that is of a resin molding product having a terminal inserting hole, a connecting terminal that is inserted into the terminal inserting hole and supported by the housing, and a retaining projection including a press-in groove parallel to a direction of insertion of the connecting terminal that is provided in an opening edge portion of the terminal inserting hole. A press-in portion is integrally formed in a side portion of the connecting terminal. Upper and lower end portions of the press-in portion are latched and retained in upper and lower surfaces opposite to each other in the press-in groove, respectively.

8 Claims, 9 Drawing Sheets

FOREIGN PATENT DOCUMENTS

| | | | |
|---|---|---|---|
| JP | 62-152375 | U | 9/1987 |
| JP | 3-131063 | U | 12/1991 |
| JP | 8-124617 | | 5/1996 |
| JP | 11-97126 | A | 4/1999 |
| JP | 2000-133344 | A | 5/2000 |
| JP | 2004-227800 | A | 8/2004 |
| JP | 2005-123143 | A | 5/2005 |
| TW | M295357 | U | 8/2006 |
| TW | 200723610 | | 6/2007 |

OTHER PUBLICATIONS

Examination Report for Taiwanese Patent Application No. 098107494 issued Mar. 8, 2012, with English translation thereof (9 pages).

* cited by examiner (A)

(B)

(A)

(B)

(A)

(B)

(A)

(B)

TERMINAL WITH A U-SHAPE SUPPORT STRUCTURE PROTRUDING FROM ITS SIDE

TECHNICAL FIELD

The present invention relates to a terminal support structure, particularly to a structure of a terminal support structure of an electric connector in which a connecting terminal is supported while inserted in a terminal inserting hole of a housing that is of a resin molding product.

BACKGROUND ART

Conventionally, for example, there is an electric connector support structure as the terminal support structure (see Patent Document 1). In the electric connector support structure, plural electric connector terminals are provided in parallel by pressing in the electric connector terminals with a predetermined pitch in a male terminal insertion port 10 provided in a housing 9 that is of the resin molding product.

Patent Document 1: Japanese Unexamined Patent Publication No. 08-124617

SUMMARY OF INVENTION

However, when the housing that is of the resin molding product is miniaturized according to a demand for device miniaturization, it is necessary to thin a wall thickness of a sidewall constituting the housing. On the other hand, during resin molding of the housing, a so-called weld line is inevitably generated around an opening of the terminal insertion port. When the electric connector terminal is press-fitted in the terminal insertion port of the housing, a force pushing and expanding the terminal insertion port acts to easily generate breakage from the weld line, and a production yield is degraded.

One or more embodiments of the present invention provides a terminal support structure in which, even if the wall thickness of the housing is thinned for the purpose of miniaturization, the housing does not break when the connecting terminal is pressed in the terminal inserting hole.

In accordance with one or more embodiments of the present invention, there is provided a terminal support structure in which a connecting terminal is supported while inserted in a terminal inserting hole provided in a housing that is of a resin molding product, wherein a retaining projection including a press-in groove parallel to a connecting terminal insertion portion is provided in an opening edge portion of the terminal inserting hole, a press-in portion is integrally formed in a side portion of the connecting terminal, and upper and lower end portions of the press-in portion are latched and retained in upper and lower surfaces opposite to each other in the press-in groove, respectively.

According to one or more embodiments of the invention, even if the opening edge portion of the terminal inserting hole is filled with resin in order to provide the retaining pin projection along a connecting terminal insertion direction, the so-called weld line is not generated in the retaining projection because the resin flows unidirectionally. Therefore, the compact terminal support structure in which a crack caused by the weld line is not generated in the housing even if the press-in portion of the connecting terminal is pressed in the press-in groove of the retaining projection can be obtained.

In the terminal support structure according to one or more embodiments of the invention, the press-in portion may laterally be formed by bending the press-in portion from a side-face edge portion of the connecting terminal, or the press-in portion may be formed by extruding a side face of the connecting terminal. In the terminal support structure according to one or more embodiments of the invention, the press-in portion may integrally be formed in a side face of the connecting terminal by electro-casting, or the press-in portion may be formed by cutting a side of the connecting terminal.

According to one or more embodiments of the invention, the connecting terminal can be supplied depending on the intended use by various production methods.

In the terminal support structure according to one or more embodiments of the invention, a guiding rib may be extended along an insertion direction from a projected end face of the retaining projection.

According to one or more embodiments of the invention, because the terminal can be pressed in along the guiding rib, advantageously the housing breakage caused by the inaccurate press-in of the connecting terminal can be prevented.

DESCRIPTION OF SYMBOLS

Figure 1:
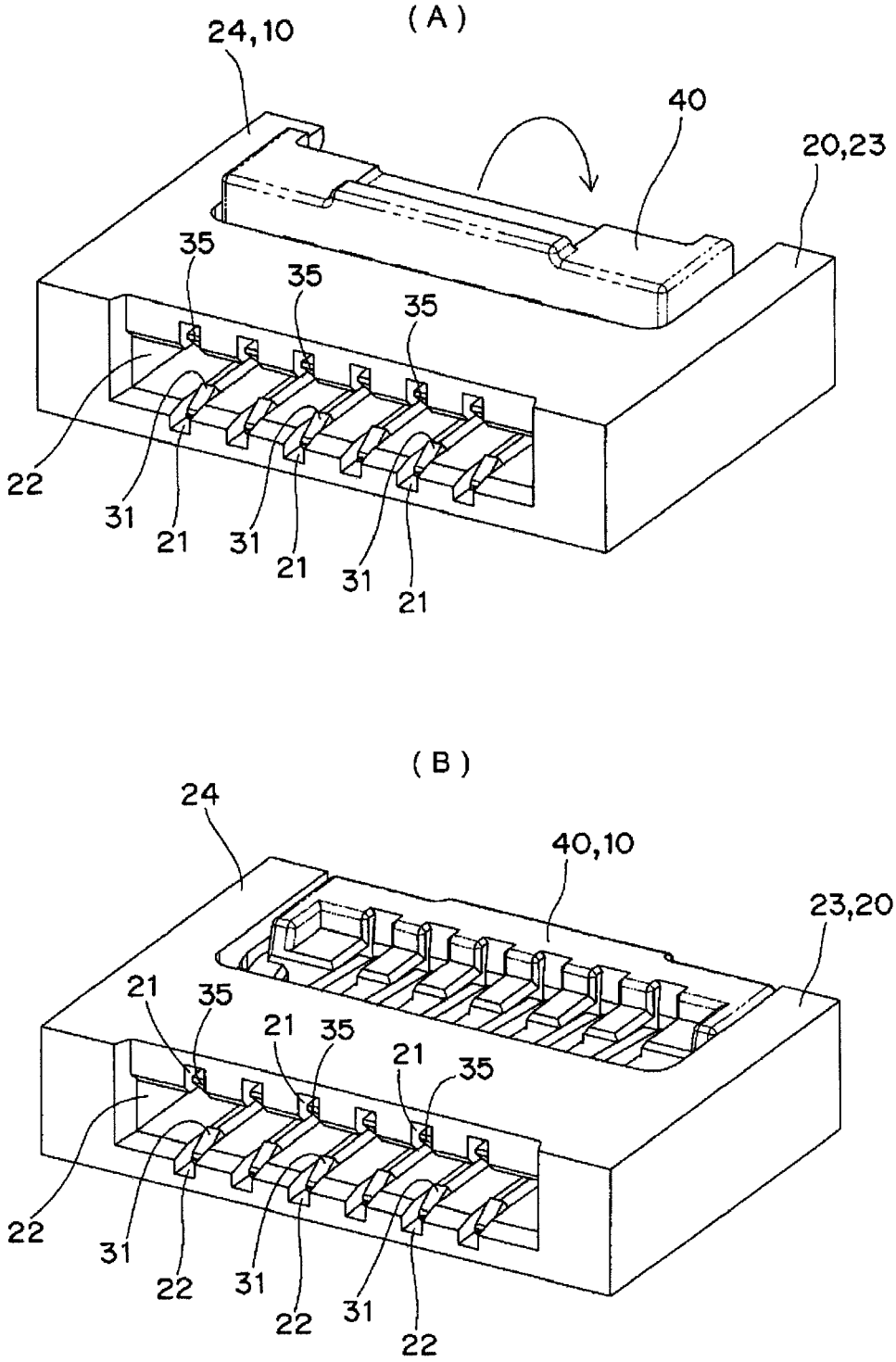
FIGS. 1A and 1B are front perspective views illustrating an electric connector to which a terminal support structure according to a first embodiment of the invention is applied before and after an operation.

10: electric connector
20: housing
20*a*: sidewall
21: terminal inserting hole
22: opening
26: guide plate
27: retaining projection
27*a*: press-in groove
28: guiding rib
30: connecting terminal
37: press-in portion
40: operating lever

DETAILED DESCRIPTION

Embodiments of the invention will be described below with reference to the accompanying drawings of FIGS. 1 to 8.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 2:
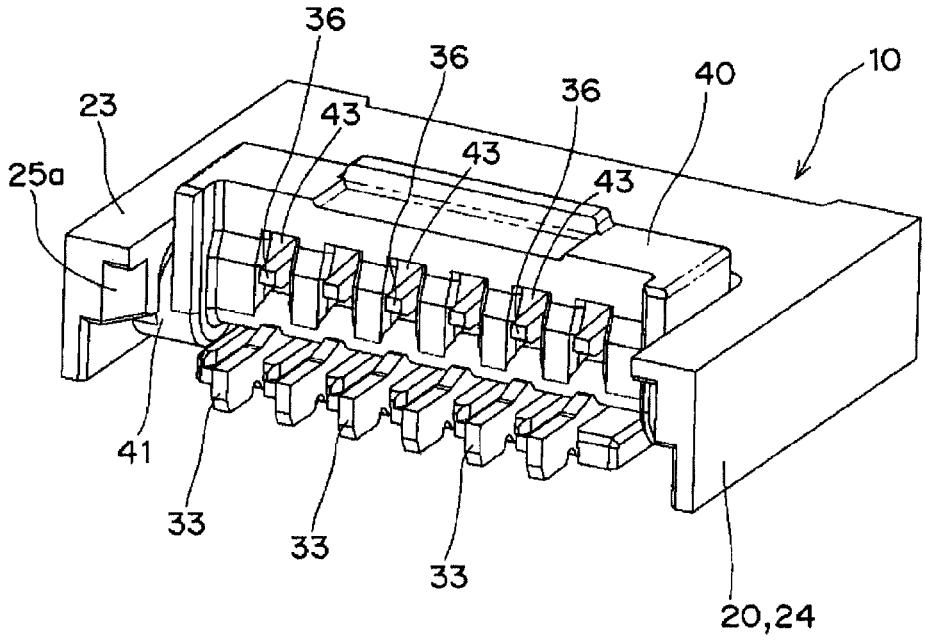
FIGS. 2A and 2B are rear perspective views illustrating the electric connector to which the terminal support structure of the first embodiment is applied before and after the operation.
Figure 2:
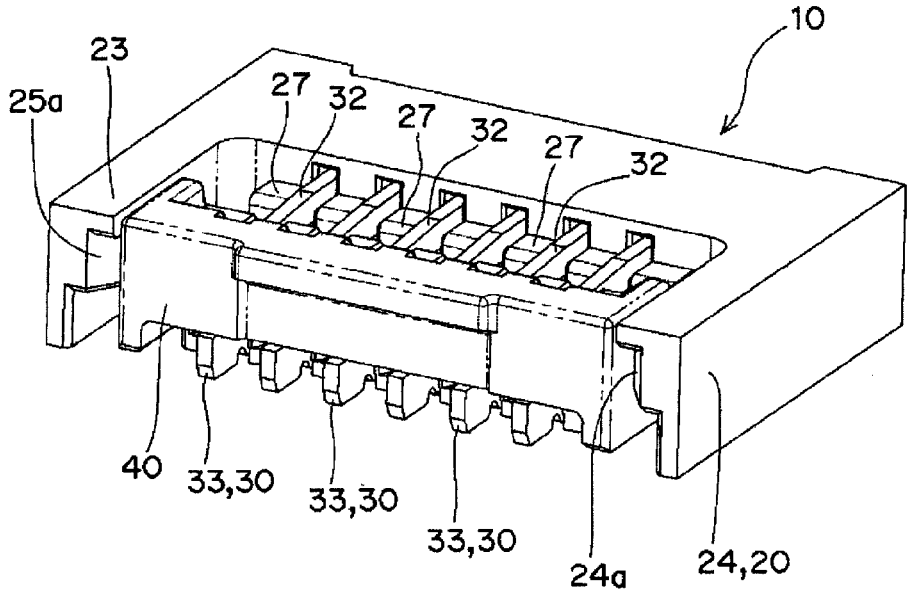

As illustrated in FIGS. 1 and 2, an electric connector 10 to which a terminal support structure according to a first embodiment of the invention is applied includes substantially a housing 20, a connecting terminal 30, and an operating lever 40.

Figure 3:
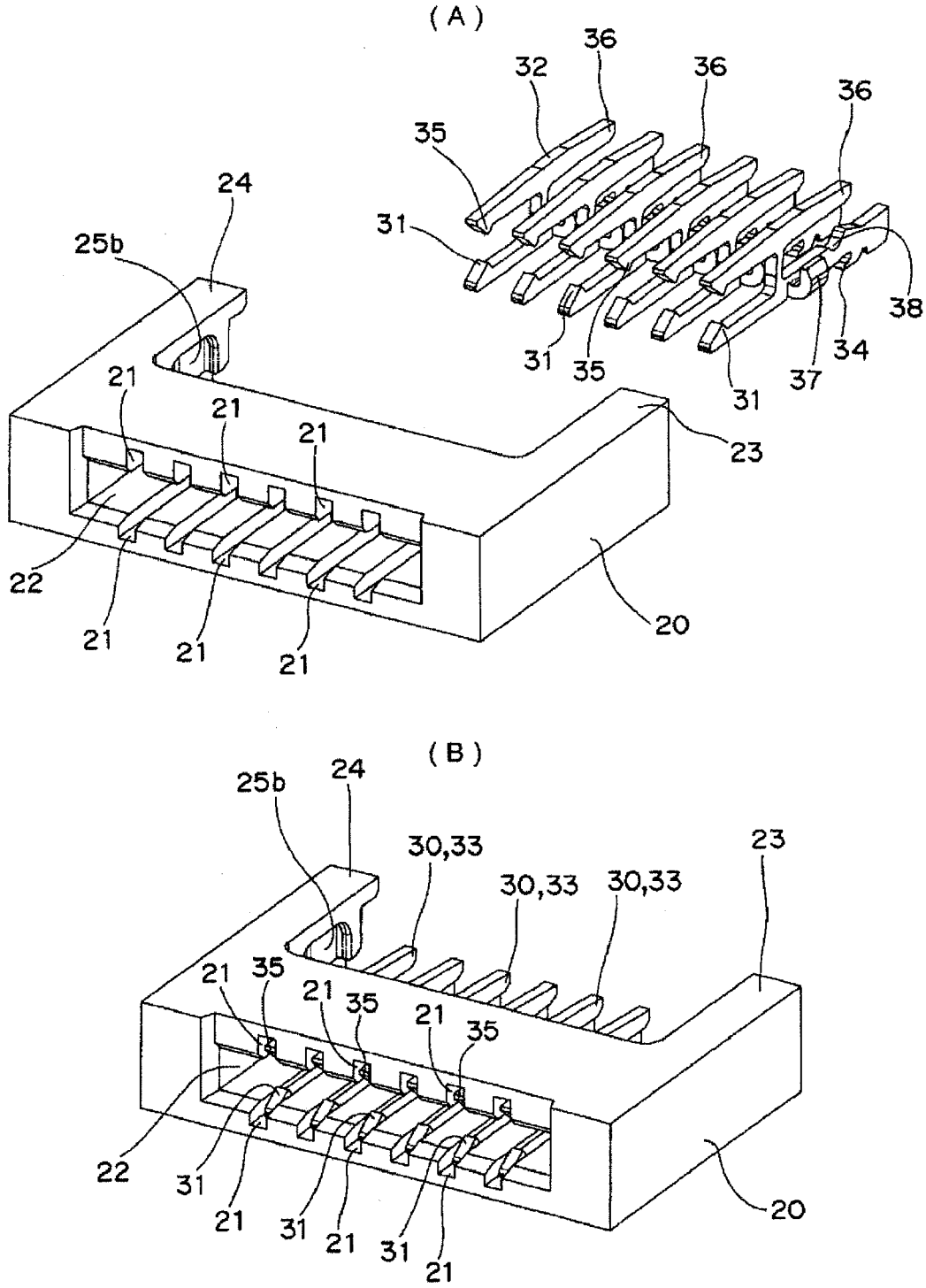
FIGS. 3A and 3B are front perspective views illustrating a housing of the electric connector of FIG. 1 before and after a connecting terminal is inserted in the housing.

As illustrated in FIG. 3, in the housing 20, terminal inserting holes 21 penetrating from a front surface of the housing 20 to a rear surface are made in parallel with a predetermined pitch, and opening 22 in which a leading-end portion of a flexible printed board (not illustrated) can be inserted is formed on a front surface side.

Figure 4:
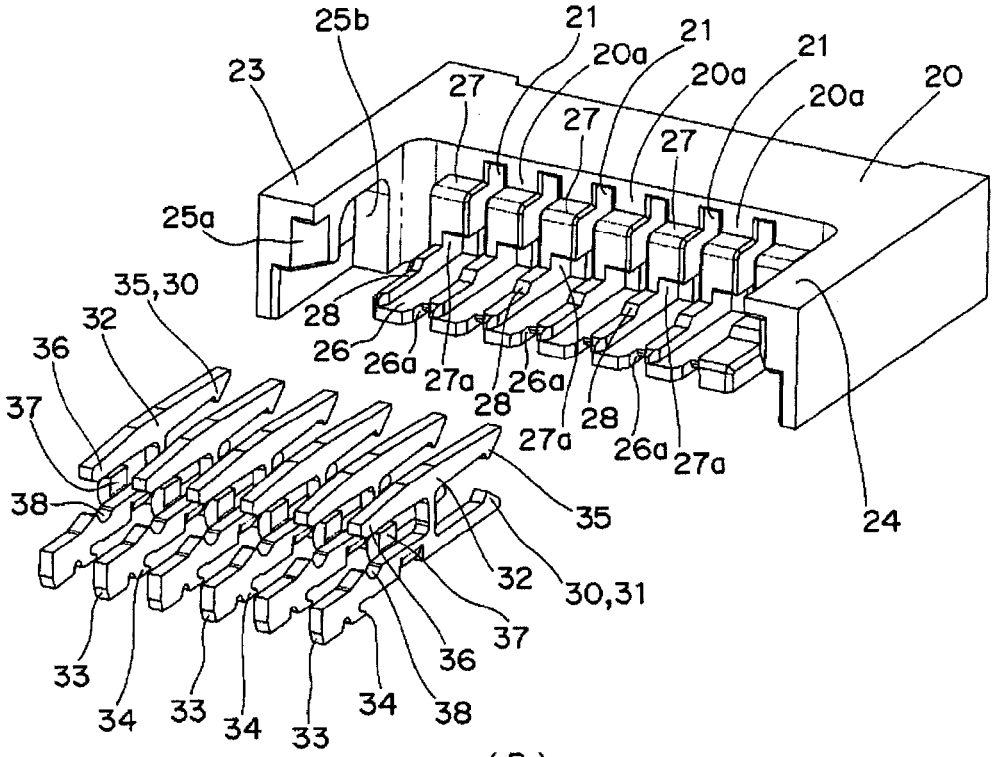
FIGS. 4A and 4B are rear perspective views illustrating the housing of the electric connector of FIG. 1 before and after the connecting terminal is inserted in the housing.
Figure 4:
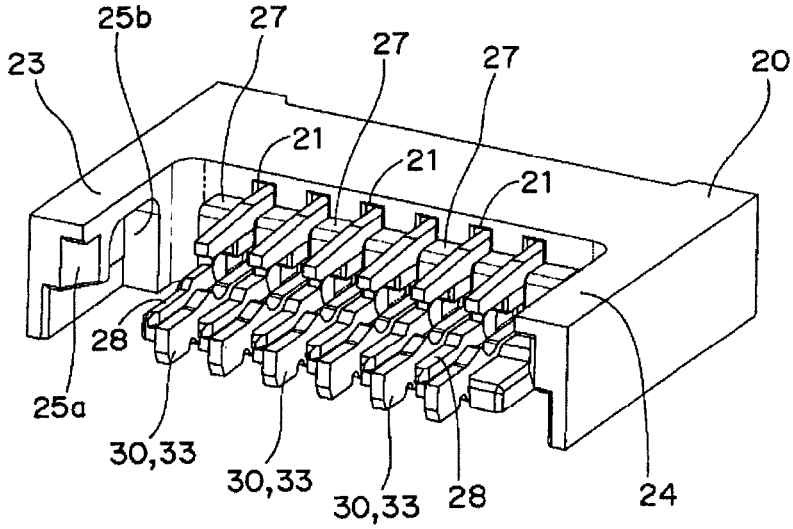
Figure 5:
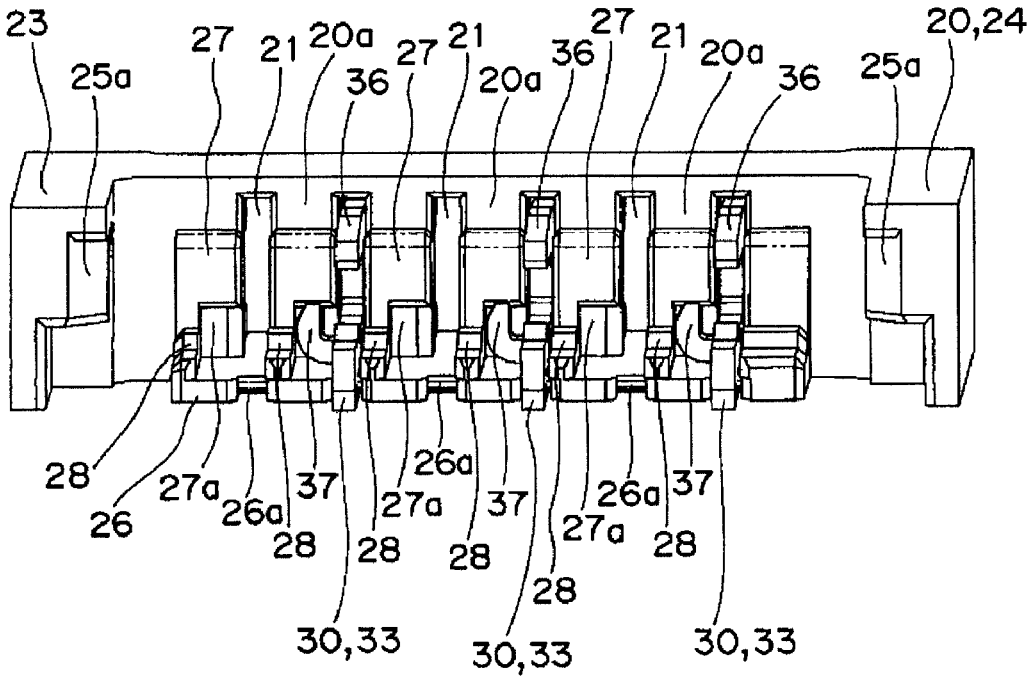
FIGS. 5A and 5B are front and rear perspective views illustrating a structure in which every other connecting terminal is supported in the housing for the sake of convenience.
Figure 5:
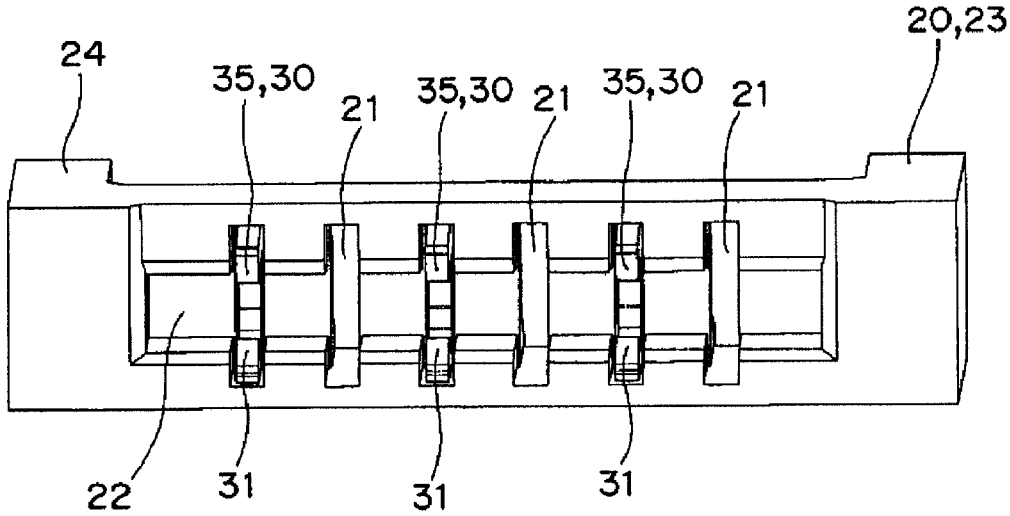
Figure 6:
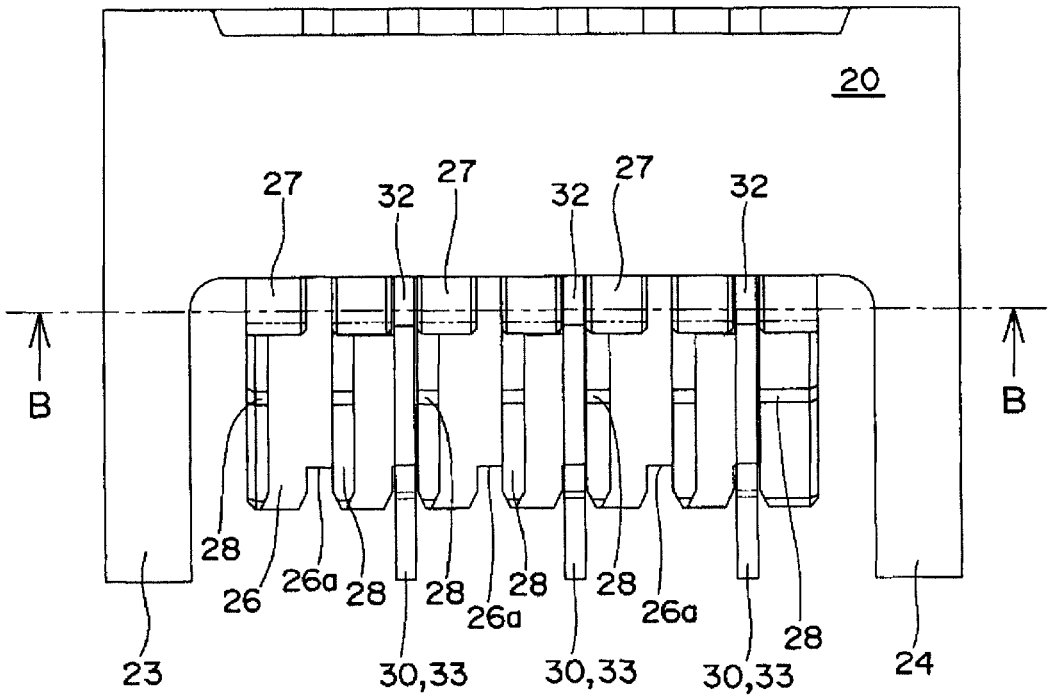
FIG. 6A is a plan view of the housing when every other connecting terminal is supported in the housing.
FIG. 6B is a sectional view taken on a line B-B.
Figure 6:
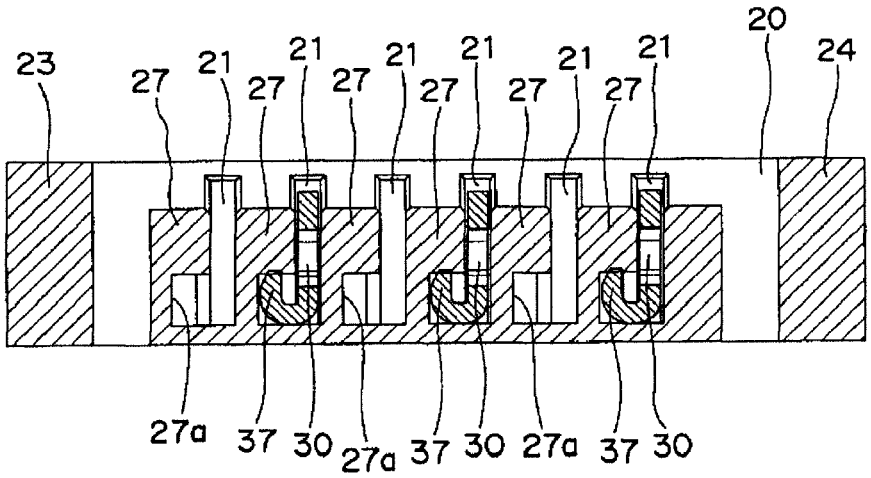

As illustrated in FIG. 4, elastic arm portions 23 and 24 are extended in parallel with a rear surface side from end portions of end faces on both sides of the housing 20. In inward faces located opposite to each other in the elastic arm portions 23 and 24, a guiding tapered surface 25*a* is formed in a leading-end edge portion, and a bearing recess 25*b* is formed at the back of the guiding tapered surface 25*a*. In the housing 20, a guide plate 26 is extended between the elastic arm portions 23 and 24 from a lower edge portion of the rear surface of the housing 20. Particularly, in the rear of the housing 20, a retaining projection 27 is laterally projected from an edge portion on one side of the terminal inserting hole 21, and a press-in groove 27*a* is formed in order to press-fit a connecting terminal 30. A guiding rib 28 leading to a lower edge portion of the retaining projection 27 is integrally formed along the guide plate 26. A latching notch 26*a* is formed in a position corresponding to the terminal inserting hole 21 in a leading-end edge portion of the guide plate 26.

There is no particular limitation to a method for resin-molding the housing 20. However, a shape, the number, and a disposition of the gates are adjusted, such that a so-called weld line is generated in a thick sidewall 20*a* located between the terminal inserting holes 21, and such that the weld lines are not generated in an upper bar and a lower bar, which join the sidewalls 20*a* and 20*a*. Therefore, advantageously the thin upper bar portion and lower bar portion, which join the sidewalls 20*a* and 20*a*, can be molded to obtain a low-profile electric connector.

Figure 7:
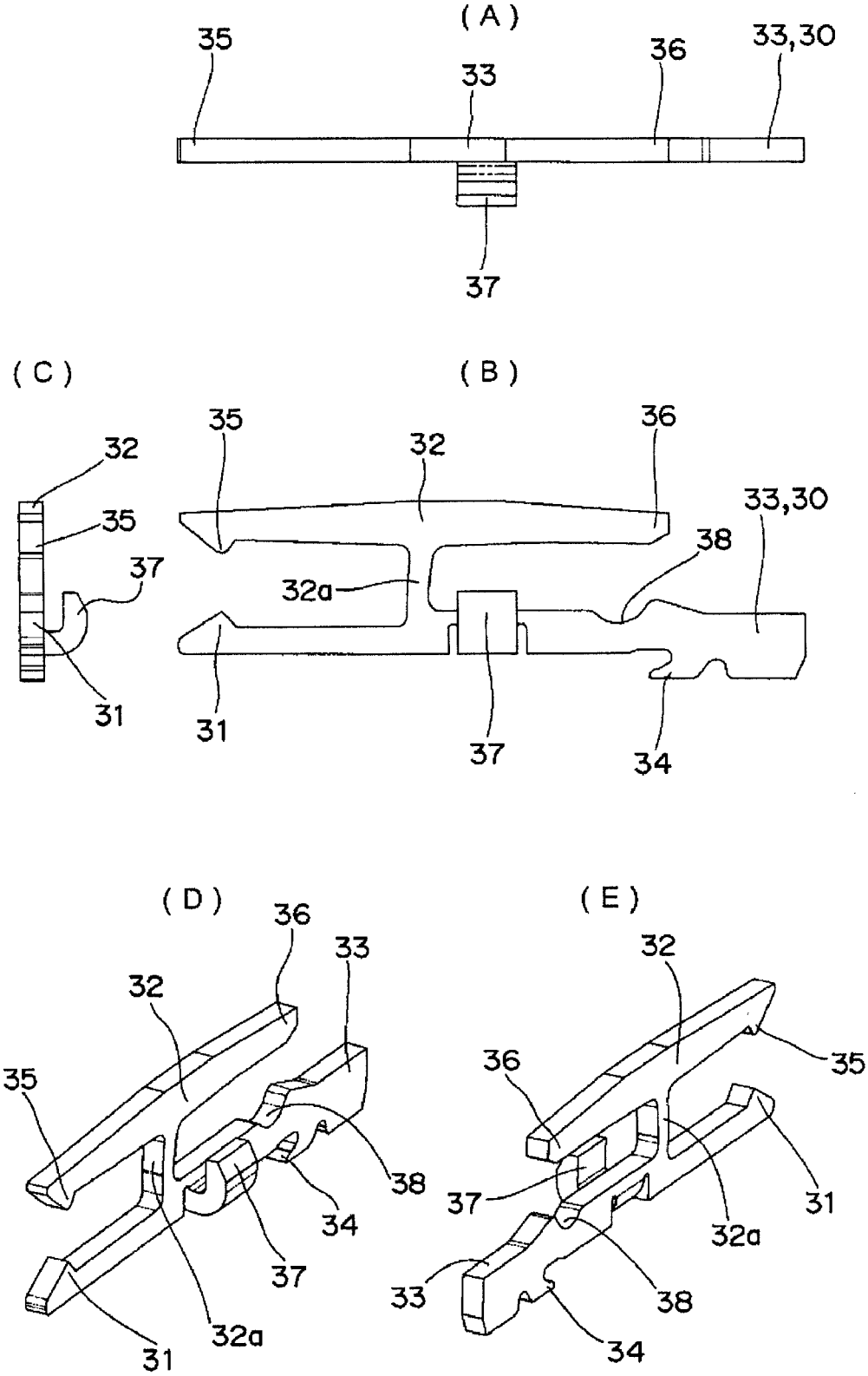
FIGS. 7A, 7B, and 7C are a plan view, a front view, and a left side view of the connecting terminal.
FIGS. 7D and 7E are perspective views of the connecting terminal when the connecting terminal is viewed from different angles.

As illustrated in FIG. 7, in the connecting terminal 30, a fixed contact 31 that is of one end portion of the connecting terminal 30 can be inserted in an insertion hole 21 of the housing 20, a substantial T-shape operating piece 32 including a support portion 32*a* is projected from a intermediate portion of the connecting terminal 30, and a latching click 34 is provided in a lower edge portion on the side of the other end portion 33. A moving contact 35 is projected downward in one end portion of the operating piece 32, and an operation receiving portion 36 is formed in the other end portion of the operating piece 32. In the connecting terminal 30, a lower-side edge portion located in a base portion of the operating piece 32 is cut, and a press-in portion 37 having a substantial L-shape in section is formed in the lower-side edge portion. A turning recess 38 is formed in an upper surface located between the press-in portion 37 and the other end portion 33.

Alternatively, the press-in portion 37 having a reversal L-shape in section may be formed in an upper-side edge portion. There is no particular limitation to the sectional shape of the press-in portion 37.

Figure 8:
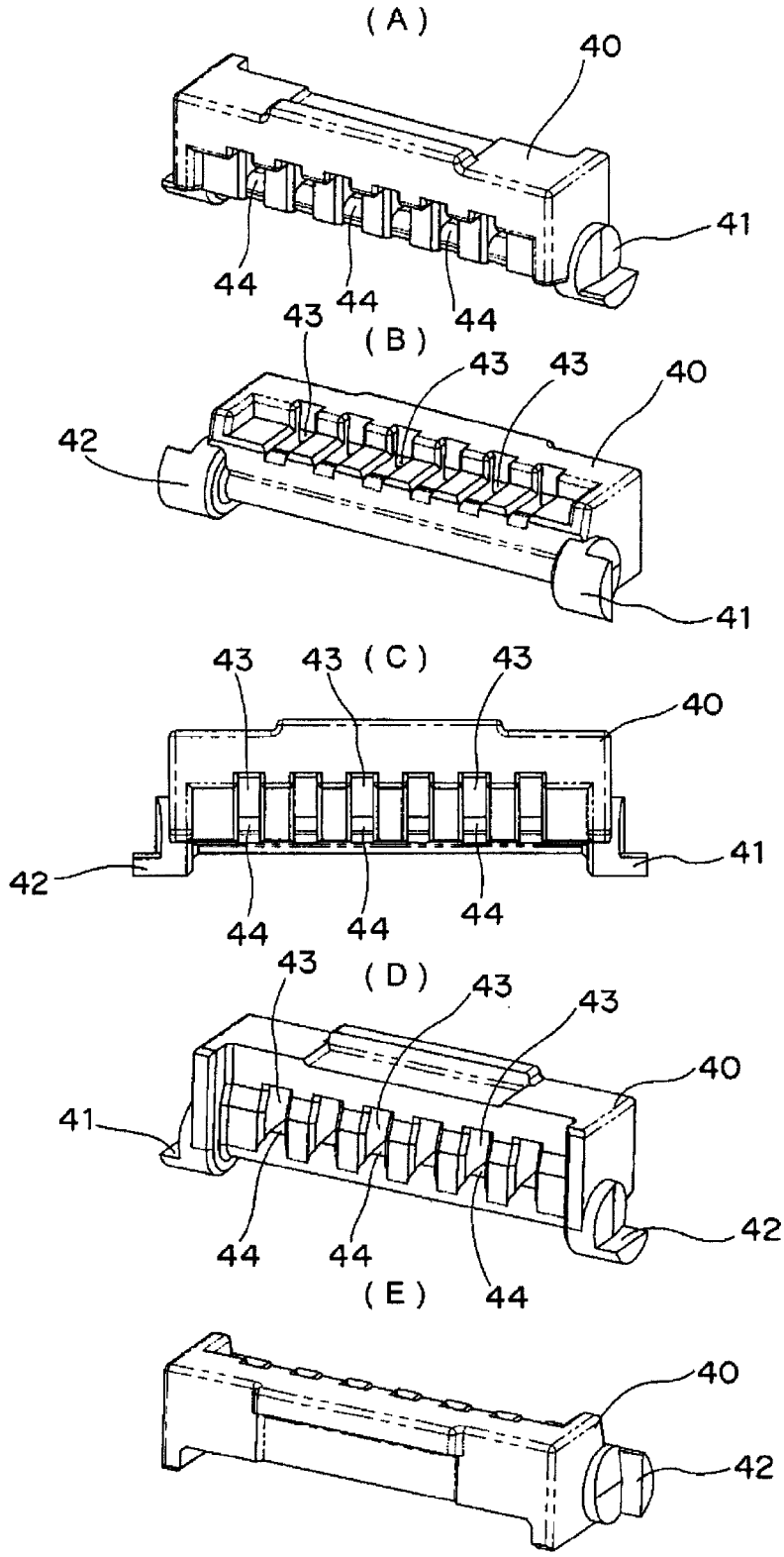
FIGS. 8A to 8E are perspective view of an operating lever when the operating lever is viewed from different angles.

As illustrated in FIG. 8, in an operating lever 40, turning shaft portions 41 and 42 are projected from end faces on both sides while shaft centers of the turning shaft portions 41 and 42 are aligned with each other. In the operating lever 40, through-holes 43 in which the operation receiving portions 36 of the connecting terminal 30 can be inserted are made with a predetermined pitch, cam portions 44 are exposed in inside faces of the through-holes 43.

A method for assembling the components will be described below.

As illustrated in FIGS. 3A and 4A, the connecting terminal 30 slides along the guiding rib 28 that is integral with the guide plate 26 of the housing 20, and the fixed contact 31 and moving contact 35 of the connecting terminal 30 are inserted in the terminal inserting hole 21. Then the press-in portion 37 provided in the connecting terminal 30 is pressed in the press-in groove 27 of the retaining projection 27. Therefore, a free end portion of the press-in portion 37 is latched in a ceiling surface of the press-in groove 27, and the latching click 34 of the connecting terminal 30 is latched and positioned in the latching notch 26*a* of the housing 20.

As illustrated in FIG. 6B, in the first embodiment, the press-in portion 37 of the connecting terminal 30 acts so as to vertically push and expand the retaining projection 27. However, because the weld line does not exist in the retaining projection 27, advantageously the housing does not break during assembly work and the good production yield is obtained.

Then operation receiving portions 36 of the connecting terminal 30 are respectively inserted in the through-holed 43 of the operating lever 40 to cause the operating lever 40 to slide along the upper surface of the connecting terminal 30. The turning shaft portions 41 and 42 move on the guiding tapered surfaces 25*a* and 24*a* provided in the elastic arm portions 23 and 24 of the housing 20, and the turning shaft portions 41 and 42 are fitted in the bearing recesses 25*b* and 25*b* while pushing and expanding elastic arm portions 23 and 24. At the same time, the cam portion 44 of the operating lever 40 is fitted in the turning recess 38 of the connecting terminal 30, and the operating lever 40 is supported while being able to be turned.

A method for connecting and fixing the flexible printed board (not illustrated) to the electric connector 10 will be described with reference to FIGS. 1 and 2.

A leading-end portion of the flexible printed board is inserted from the opening 22 of the housing 20 of FIG. 1A until the leading-end portion abuts on an inner side face of the housing 20. As illustrated in FIG. 1B, when the operating lever 40 is pushed down by turning the operating lever 40 about the shaft centers of the turning shaft portions 41 and 42, the cam portion 44 pushes up the operation receiving portion 36 of the connecting terminal 30. Therefore, the substantial T-shape operating piece 32 is inclined with the support portion 32*a* as a fulcrum point, the moving contact 35 and/or fixed contact 31 comes into press-contact with a connection portion provided in at least one of an upper-surface leading-end portion and a lower-surface leading-end portion of the flexible printed board, and the flexible printed board is retained.

In the first embodiment, because the cam portion 44 has a sectional surface formed into a substantially ellipsoidal shape, a torque decreases rapidly when the cam portion 44 is turned by a predetermined angle, thereby obtaining operation a solid operation feeling.

On the other hand, when the flexible printed board is detached from the electric connector 10, the cam portion 44 is reversely turned by turning the operating lever 40 in the opposite direction, bending moment to the operation receiving portion 36 of the connecting terminal 30 is released, and the connection state between the moving contact 35 and the fixed contact 31 is released. Then the flexible printed board is drawn from the housing 20.

Figure 9:
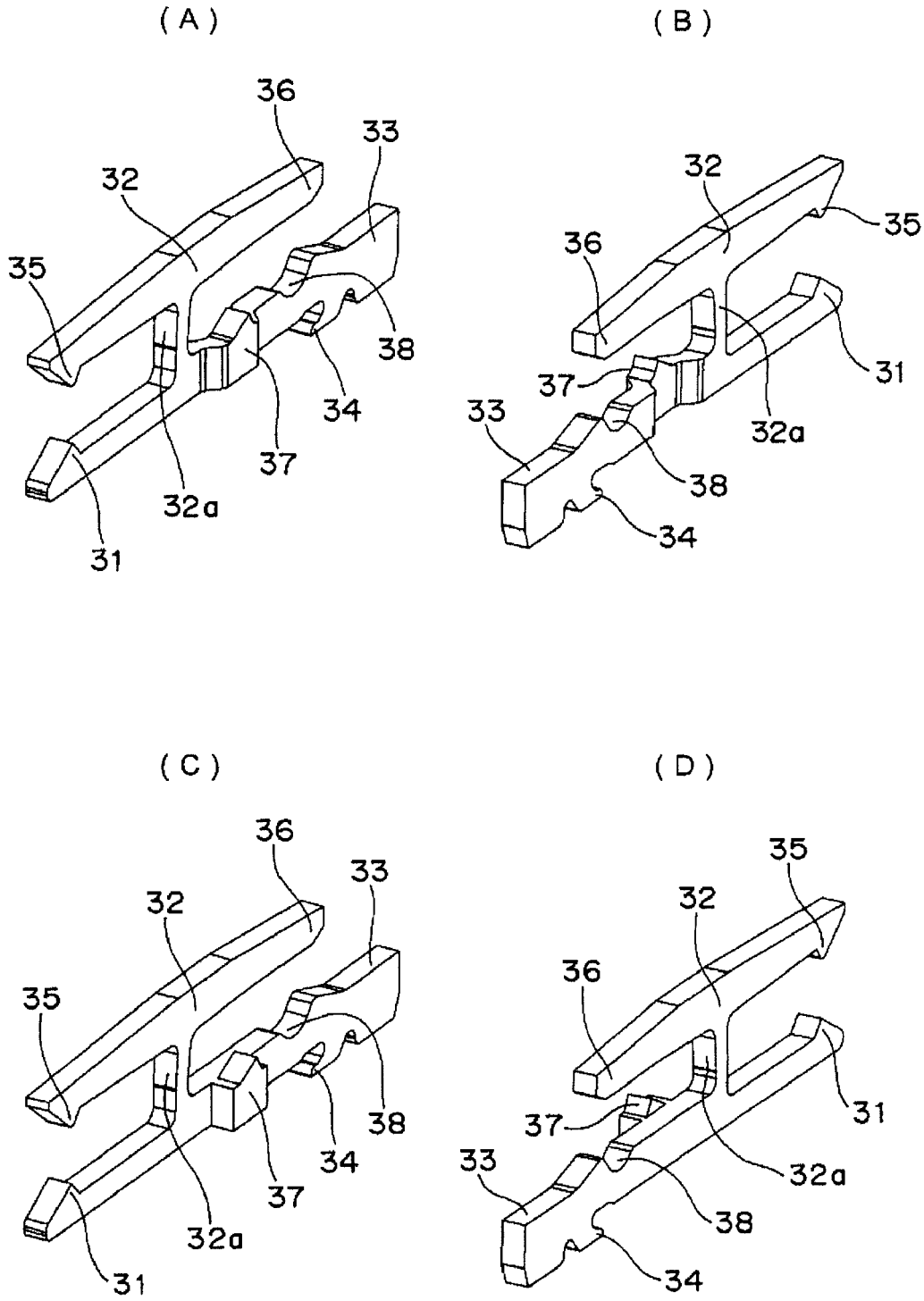
FIGS. 9A and 9B are perspective views of a connecting terminal according to a second embodiment of the invention when the connecting terminal is viewed from different angles.
FIGS. 9C and 9D are perspective views of a connecting terminal according to a third embodiment of the invention when the connecting terminal is viewed from different angles.

The connecting terminal 30 is not limited to the first embodiment. For example, as illustrated in FIGS. 9A and 9B, the press-in portion 37 may be formed by extruding a base portion of the support portion 32*a* of the connecting terminal 30 (second embodiment). As illustrated in FIGS. 9C and 9D, the press-in portion 37 and the connecting terminal 30 may be integrally formed by electro-casting or cutting (third embodiment).

The terminal support structure of the invention is not limited to the electric connector, but the terminal support structure can also be applied to other electronic components.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A terminal support structure comprising:

a housing that is of a resin molding product having a terminal inserting hole;

a connecting terminal that is inserted into the terminal inserting hole and supported by the housing;

a retaining projection including a press-in groove parallel to a direction of insertion of the connecting terminal that is provided in an opening edge portion of the terminal inserting hole; and a press-in portion integrally formed in a side portion of the connecting terminal, wherein the press-in portion protrudes from the side portion of the connecting terminal and forms a U-shape with the side portion, as a cross-section shape perpendicular to the direction of insertion of the connecting terminal, such that the press-in portion is fitted in the press-in groove; and wherein upper and lower end portions of the press-in portion are latched and retained in upper and lower surfaces opposite to each other in the press-in groove, respectively.

2. The terminal support structure according to claim 1, wherein the press-in portion is formed by extruding a side face of the connecting terminal.

3. The terminal support structure according to claim 1, wherein the press-in portion is integrally formed in a side face of the connecting terminal by electro-casting.

4. The terminal support structure according to claim 1, wherein the press-in portion is formed by cutting a side of the connecting terminal.

5. The terminal support structure according to claim 1, wherein a guiding rib is extended along an insertion direction from a projected end face of the retaining projection.

6. The terminal support structure according to claim 2, wherein a guiding rib is extended along an insertion direction from a projected end face of the retaining projection.

7. The terminal support structure according to claim 3, wherein a guiding rib is extended along an insertion direction from a projected end face of the retaining projection.

8. The terminal support structure according to claim 4, wherein a guiding rib is extended along an insertion direction from a projected end face of the retaining projection.

* * * * *